US010365027B2

(12) United States Patent
Koppineedi

(10) Patent No.: US 10,365,027 B2
(45) Date of Patent: Jul. 30, 2019

(54) SIMPLIFIED AND ENERGY EFFICIENT MULTI TEMPERATURE UNIT

(71) Applicant: THERMO KING CORPORATION, Minneapolis, MN (US)

(72) Inventor: Srinivasa Rao Koppineedi, Bangalore (IN)

(73) Assignee: THERMO KING CORPORATION, Minneapolis, MN (US)

( * ) Notice: Subject to any disclaimer, the term of this patent is extended or adjusted under 35 U.S.C. 154(b) by 459 days.

(21) Appl. No.: 15/056,464

(22) Filed: Feb. 29, 2016

(65) Prior Publication Data

US 2017/0248359 A1 Aug. 31, 2017

(51) Int. Cl.
*F25D 11/00* (2006.01)
*F25D 17/06* (2006.01)

(52) U.S. Cl.
CPC ..... *F25D 17/06* (2013.01); *F25D 11/003* (2013.01)

(58) Field of Classification Search
CPC ..... F25D 13/02; F25D 11/025; F25D 19/04; F25D 19/003
USPC ..... 62/419
See application file for complete search history.

(56) References Cited

U.S. PATENT DOCUMENTS 4,505,126 A * 3/1985 Jones ..... B60P 3/205 280/43.22
4,553,584 A * 11/1985 Bloomquist ..... B60H 1/00014 165/263
4,621,335 A 11/1986 Bluish et al.
4,829,774 A 5/1989 Wassibauer et al.
4,899,554 A * 2/1990 Kato ..... B60H 1/323 62/252
5,123,251 A 6/1992 Hanson
5,140,434 A 8/1992 Blessinger et al.
5,140,436 A 8/1992 Blessinger
5,916,253 A * 6/1999 Amr ..... B60H 1/00428 62/239
6,072,645 A 6/2000 Sprague
6,543,242 B2 4/2003 Reason et al.
(Continued)

OTHER PUBLICATIONS

"http://www.insulatedtransportproducts.com/Products/Bulkhead-Accessories"; Insulated Transport Products, Bulkhead Accessories, Copyright 2016.

*Primary Examiner* — Jianying C Atkisson
*Assistant Examiner* — Paul S Schwarzenberg
(74) *Attorney, Agent, or Firm* — Hamre, Schumann, Mueller & Larson, P.C.

(57) ABSTRACT

Methods and systems for an energy efficient MTRS are provided. In one embodiment, a refrigerated transport unit is provided that includes a multi-zone transport unit and an energy efficient MTRS. The multi-zone transport unit includes an internal space separated into a first zone and a second zone. The internal space includes a zone separator separating and thermally isolating the first zone and the second zone. The energy efficient MTRS is configured to control and maintain a separate environmental condition requirement of each of the first zone and the second zone. The energy efficient MTRS includes a remote fan unit provided between the first zone and the second zone. The remote fan unit is configured to provide a heat exchange between the first zone and the second zone for providing climate control within the second zone.

18 Claims, 3 Drawing Sheets

(56) References Cited

U.S. PATENT DOCUMENTS

| | | | | |
|---|---|---|---|---|
| 7,451,614 | B2 * | 11/2008 | Luehrs | F25D 11/02 62/441 |
| 8,046,183 | B2 | 10/2011 | Dobyns et al. | |
| 8,521,475 | B2 | 8/2013 | Lin et al. | |
| 8,768,141 | B2 | 7/2014 | Chan | |
| 8,800,309 | B2 | 8/2014 | Buda et al. | |
| 2005/0241323 | A1 | 11/2005 | Miller et al. | |
| 2008/0092564 | A1 * | 4/2008 | Sulc | B60P 3/20 62/90 |
| 2013/0090853 | A1 | 4/2013 | Anderson | |
| 2013/0247605 | A1 * | 9/2013 | Laudet | B60H 1/00378 62/239 |

* cited by examiner

SIMPLIFIED AND ENERGY EFFICIENT MULTI TEMPERATURE UNIT

FIELD

The embodiments described herein are directed to a multi-zone transport refrigeration system (MTRS) for a refrigerated transport unit. More particularly, the embodiments described herein relate to methods and systems for an energy efficient MTRS.

BACKGROUND

A transport refrigeration system (TRS) is generally used to control an environmental condition (e.g., temperature, humidity, air quality, and the like) within a transport unit (e.g., a trailer, a container on a flat car, an intermodal container, etc.), a truck, a box car, or other similar transport unit. In some embodiments, the transport unit can include a plurality of zones and the TRS can be a multi-zone TRS (MTRS) that is configured to provide independent climate control to each of the plurality of zones within the transport unit.

SUMMARY

The embodiments described herein are directed to a multi-zone transport refrigeration system (MTRS) for a refrigerated transport unit. More particularly, the embodiments described herein relate to methods and systems for an energy efficient MTRS.

In particular, the embodiments described herein can increase the energy efficiency of a MTRS. The embodiments described herein can also simplify the MTRS by reducing the number of refrigeration system components and thereby increase the reliability of the MTRS. Also, the embodiments described herein can reduce a heat exchanger fluid pressure drop within the MTRS, reduce the amount of heat exchanger charge required by the MTRS, and increase the efficiency of the MTRS. Further, the embodiments described herein can reduce the number of remote evaporators used in the MTRS. Moreover, the embodiments described herein can reduce complexity in the controls of the MTRS. Also, the embodiments described herein can increase the flexibility in selecting the size of each of the zones of the MTRS.

In one embodiment, the MTRS includes a transport refrigeration unit (TRU) with a host evaporator for a host zone of the transport unit and one or more fan coil units for each of the remaining zones of the transport unit. The fan coil unit can be provided between two zones (e.g., a first zone and a second zone) of the transport unit. Also, the fan coil unit can include a pump to circulate coolant from a first zone to a second zone to exchange heat between the first zone and the second zones. The fan coil unit can also include a fan that can be a variable speed fan to provide precise temperature control of a zone of the transport unit.

The MTRS can be configured such that the zone temperature controlled by the host unit is set to have the lowest temperature set point when compared to the other zones. The pump of the fan coil unit can circulate coolant from, for example, the first zone to the second zone in order to provide a heat exchange between the first zone and the second zone that enables temperature control of the second zone. Similarly, a second fan coil unit can be provided between a second zone and a third zone. Accordingly, the pump in the second fan coil unit can circulate coolant from, for example, the second zone to the third zone in order to provide a heat exchange between the second zone and the third zone that enables temperature control of the third zone. In this embodiment, an electrical heater and/or an engine coolant can be used for heating one or more zones of the transport unit. In this embodiment, the fan coil unit can include multiple fans.

An advantage of this embodiment is that installation is simplified, cost of the MTRS is reduced, and the reliability of the MTRS can be increased as no remote evaporator units are required and the MTRS requires less refrigeration system components. Also, the MTRS can increase in efficiency as there is a low suction pressure loss. The heat exchanger fluid charge can be reduced. Further, the engine size and/or load can be optimized as the MTRS can generally operate at a low set point and/or a low load. Also, control of the MTRS can be simplified. Moreover, the number of defrost operations of the MTRS can be reduced as the MTRS includes only a single evaporator with no remote evaporator units. Another advantage is that the placement of zone separators for separating the zones of the transport unit can be adjusted, thereby increasing the flexibility in size of each of the zones of the MTRS. The fan coil unit(s) can be mounted on a zone separator and/or a ceiling of the transport unit. The fan coil unit(s) can also be mounted on a railing on a ceiling of the transport unit and can be moved to accommodate different zone size configurations.

In another embodiment, the MTRS includes a transport refrigeration unit (TRU) with a host evaporator for a host zone of the transport unit and one or more filter and fan units for each of the remaining zones of the transport unit. The filter and fan unit can include a filter, a fan and a damper. The filter can be a high efficient and/or odor control carbon air filter configured to exchange filtered air between zones of the transport unit. The fan can be a variable speed fan to provide precise temperature control of a zone of the transport unit. The damper can be adjusted using a stepper motor in order to control air volume entering the filter and fan unit. In this embodiment, an electrical heater and/or an engine coolant can be used for heating one or more zones of the transport unit. In this embodiment, the filter and fan unit can include multiple fans and/or multiple dampers.

The MTRS can be configured such that the zone temperature controlled by the host unit (e.g., host zone) is set to have the lowest temperature set point when compared to the other zones (e.g., a second zone, a third zone, etc.). The host zone can exchange air with a zone immediately adjacent to the host zone (e.g., the second zone) via the filter and fan unit to provide a heat exchange that enables temperature control for the second zone. Similarly, the second zone can exchange air with a zone other than the host zone that is immediately adjacent to the second zone (e.g., the third zone) via a second filter and fan unit to provide a heat exchange that enables temperature control for the third zone.

An advantage of this embodiment is that installation is simplified, cost of the MTRS is reduced, and the reliability of the MTRS can be increased as no remote evaporator units are required and the MTRS requires less refrigeration system components. Also, the MTRS can increase in efficiency as there is a low suction pressure loss. The heat exchanger fluid charge can be reduced. Further, the engine size and/or load can be optimized as the MTRS can generally operate at a low set point and/or a low load. Also, control of the MTRS can be simplified. Moreover, the number of defrost operations of the MTRS can be reduced as the MTRS includes only a single evaporator with no remote evaporator units. Another advantage is that the placement of zone separators for separating the zones of the transport unit can be adjusted, thereby increasing the flexibility in size of each of the zones of the MTRS. The filter and fan unit(s) can be mounted on a zone separator and/or a ceiling of the transport unit.

In one embodiment, a refrigerated transport unit is provided that includes a multi-zone transport unit and an energy efficient MTRS. The multi-zone transport unit includes an internal space separated into a first zone and a second zone. The internal space includes a zone separator separating and thermally isolating the first zone and the second zone. The energy efficient MTRS is configured to control and maintain a separate environmental condition requirement of each of the first zone and the second zone. The energy efficient MTRS includes a remote fan unit provided between the first zone and the second zone. The remote fan unit is configured to provide a heat exchange between the first zone and the second zone for providing climate control within the second zone.

In another embodiment, an energy efficient MTRS configured to control and maintain a separate environmental condition requirement of each of a first zone and a second zone within an interior space of a transport unit is provided. The energy efficient MTRS includes a host unit and a remote fan unit. The host unit is configured to provide climate control within the first zone. The host unit includes a host heat exchanger circuit for directing a host heat exchange fluid. The remote fan unit is provided between the first zone and the second zone. The remote fan unit is separate from, independent of, and isolated from the host unit. The remote fan unit is configured to provide a heat exchange between the first zone and the second zone for providing climate control within the second zone.

Other features and aspects will become apparent by consideration of the following detailed description and accompanying drawings.

DETAILED DESCRIPTION

Figure 1:
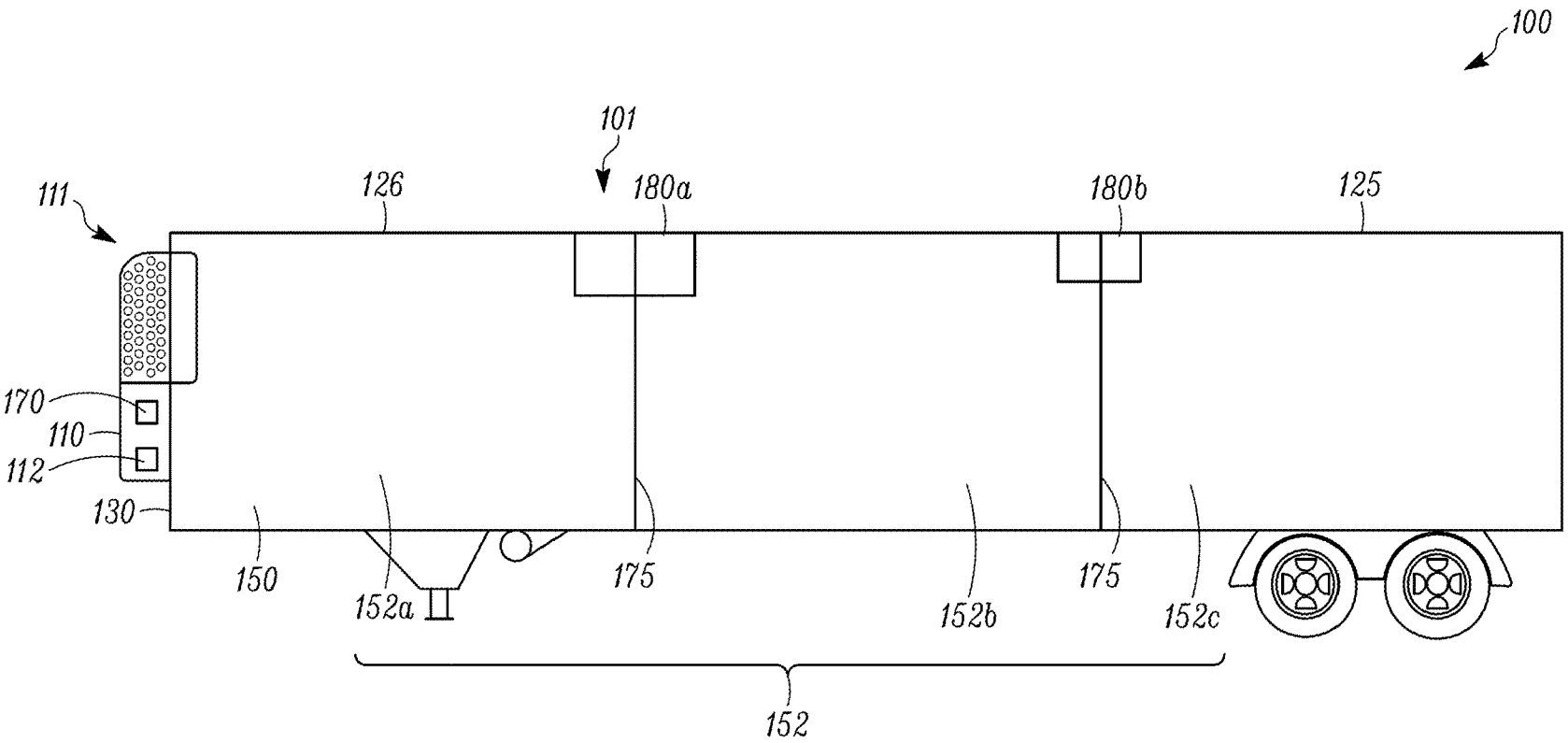
FIG. 1 illustrates a schematic cross sectional side view of a refrigerated transport unit with an energy efficient MTRS.

The embodiments described herein are directed to a multi-zone transport refrigeration system (MTRS) for a refrigerated transport unit. More particularly, the embodiments described herein relate to methods and systems for an energy efficient MTRS.

In particular, the embodiments described herein can increase the energy efficiency of a MTRS. The embodiments described herein can also simplify the MTRS by reducing the number of refrigeration system components and thereby increase the reliability of the MTRS. Also, the embodiments described herein can reduce a heat exchanger fluid pressure drop within the MTRS, reduce the amount of heat exchanger charge required by the MTRS, and increase the efficiency of the MTRS. Further, the embodiments described herein can reduce the number of remote evaporators used in the MTRS. Moreover, the embodiments described herein can reduce complexity in the controls of the MTRS. Also, the embodiments described herein can increase the flexibility in selecting the size of each of the zones of the MTRS.

References are made to the accompanying drawings that form a part hereof, and in which is shown by way of illustration of the embodiments in which the methods and systems described herein may be practiced.

The TRS is generally used to control an environmental condition (e.g., temperature, humidity, air quality, and the like) within a transport unit (e.g., a trailer, a container on a flat car, an intermodal container, etc.), a truck, a box car, or other similar transport unit. The transport unit can include a plurality of zones and the TRS can be a multi-zone TRS (MTRS). Each zone may require a climate condition (e.g., temperature, humidity, air quality, etc.) that is different from other zone(s). The MTRS can be configured to provide independent climate control to each of the plurality of zones within the transport unit.

The MTRS may have one host unit and one or more remote fan units (together referred to herein as heat exchanger units) that are each configured to provide climate control to each of the one or more zones within the multi-zone transport unit. A TRU of the MTRS may include a compressor, an expansion valve, a first heat exchanger (e.g., condenser), and a host unit. The host unit can include a second heat exchanger (e.g., a host evaporator), one or more fan(s) for providing climate control within the particular zone the host unit is located, one or more flow regulating devices (e.g., solenoid valve(s), etc.) for controlling the amount of heat exchanger fluid flow into the host unit, and one or more throttling devices (e.g., electronic throttling valve(s), etc.) for controlling the amount of heat exchanger fluid flow available to a suction end of the compressor of the MTRS.

Each remote fan unit is provided between two adjacent zones of the transport unit. In one embodiment, the remote fan unit can be a fan coil unit that includes a pump configured to circulate a coolant between two zones of the transport unit and a fan configured to provide temperature control for a zone of the transport unit. In another embodiment, the remote fan unit can be a filter and fan unit that includes a filter configured to exchange filtered air between two zones of the transport unit, a fan configured to provide temperature control for a zone of the transport unit, and a damper configured to control a volume of air entering into the filter and fan unit. It is to be appreciated that the fan coil unit can include two or more fans. It is also to be appreciated that the filter and fan unit can include two or more fans and two or more dampers.

The MTRS can be used to, for example, cool, heat, and defrost the two or more zones of the transport unit. Note that in some instances, the remote unit may have two or more remote heat exchangers (e.g., a first remote evaporator and a second remote evaporator connected in parallel or in series).

The MTRS includes a refrigeration circuit and a controller (e.g., a MTRS controller) that is configured to manage, command, direct, and regulate the behavior of one or more components of the refrigeration circuit (e.g., an evaporator, a condenser, a compressor, an expansion device, etc.). The MTRS controller can also be configured to manage, command, direct, and regulate the behavior of the host unit and the one or more remote fan units.

The term "ambient temperature" as used herein refers to an air temperature outside of the transport unit.

FIG. 1 illustrates a transport unit (TU) 125 with an energy efficient MTRS 100, according to one embodiment. The TU 125 includes an internal space 150 and can be towed, for example, by a tractor (not shown). The TU 125 shown in FIG. 1 is a trailer unit. However, it will be appreciated that the embodiments described herein are not limited to trucks and trailer units, but can apply to any other type of transport unit (e.g., a container on a flat car, an intermodal container, etc.), a truck, a box car, or other similar transport unit.

The energy efficient MTRS 100 includes a transport refrigeration unit (TRU) 110 that provides environmental control (e.g. temperature, humidity, air quality, etc.) within the internal space 150. The energy efficient MTRS 100 also includes a MTRS controller 170 and one or more sensors (not shown) that are configured to measure one or more parameters of the energy efficient MTRS 100 and communicate parameter data to the MTRS controller 170. The energy efficient MTRS 100 is powered by a power source 112. The TRU 110 is disposed on a front wall 130 of the TU 125. In other embodiments, it will be appreciated that the TRU 110 can be disposed, for example, on a rooftop 126 or another wall of the TU 125.

The programmable MTRS Controller 170 may comprise a single integrated control unit or may comprise a distributed network of TRS control elements. The number of distributed control elements in a given network can depend upon the particular application of the principles described herein. The MTRS controller 170 is configured to control operation of the energy efficient MTRS 100. The MTRS controller 170 may also regulate the operation of the energy efficient MTRS 100 to prevent overloading a power source, for example a combustion engine (e.g., a diesel engine, a natural gas engine, a petrol engine, etc.), during an operational mode change of the TRS as described in more detail below.

As shown in FIG. 1, the power source 112 is disposed in the TRU 110. In other embodiments, the power source 112 can be separate from the TRU 110. Also, in some embodiments, the power source 112 can include two or more different power sources disposed within or outside of the TRU 110. In some embodiments, the power source 112 can include a combustion engine, a battery, an alternator, a generator, a solar panel, a fuel cell, etc. When the power source 112 includes a combustion engine, the combustion engine can be less than a 25 horse power engine. In some embodiments, the combustion engine can be a 25 horse power or greater engine. Also, the combustion engine can be a two speed engine, a variable speed engine, etc. In some instances, the power source 112 can be required to not exceed a predefined power level. Exceeding the predefined power level can, for example, prevent the power source 112 from overloading, can prevent the power source 112 from exceeding, for example, government or customer requirements (e.g., noise level regulations, emission regulations, fuel usage limits, etc.).

The internal space 150 is divided into a plurality of zones 152. The term "zone" means a part of an area of the internal space 150 separated by walls 175. In some examples, each of the zones 152 can maintain a set of environmental condition parameters (e.g. temperature, humidity, air quality, etc.) that is independent from other zones 152.

Note that in FIG. 1 the internal space 150 is divided into three zones: a first zone 152*a*; a second zone 152*b*; and a third zone 152*c*. Each of the zones 152 shown in FIG. 1 is divided into substantially equal areas. However, it is to be realized that the internal space 150 may be divided into any number of zones and in any size configuration that is suitable for environmental control of the different zones.

The energy efficient MTRS 100 is configured to control and maintain separate environmental condition requirements in each of the zones 152. The energy efficient MTRS 100 includes a host unit 111 provided within the TRU 110 for providing climate control within the first zone 152*a* and a plurality of remote fan units 180 disposed in the TU 125. Namely a first remote fan unit 180*a* is disposed between the first zone 152*a* and the second zone 152*b* and a second remote fan unit 180*b* is disposed between the second zone 152*b* and the third zone 152*c*. The host unit 111 and the remote fan units 180 are collectively referred to herein as heat exchange units. In one embodiment, the first zone 152*a* can be a frozen temperature zone operating to maintain a temperature set point within a frozen temperature range and the second and third zones 152*b*, 152*c* can be fresh temperature zones operating to maintain a temperature set point within a fresh temperature range. In one embodiment, for example, the frozen temperature range can be between about −25° F. to about 15° F. and the fresh temperature range can be between about 16° F. to about 90° F. In another embodiment, for example, the frozen temperature range can be between about −25° F. to about 24° F. and the fresh temperature zone can be between about 26° F. to about 90° F. It will be appreciated that in other embodiments, any of the first, second and third zones 152*a-c* can be a fresh temperature zone operating to maintain a temperature set point within a fresh temperature range or a frozen temperature zone operating to maintain a temperature set point within a frozen temperature range. In this embodiment, when the energy efficient MTRS 100 is in a cooling mode, the first zone 152*a* with the host unit 111 is set to have the lowest set point temperature among the zones 152. That is, the second and/or third zone 152*b*, 152*c* can have a set point temperature that is equal to or greater than the set point temperature of the first zone 152*a* but cannot have a set point temperature that is lower than the set point temperature of the first zone 152*a*.

Each remote fan unit 180*a*, 180*b* is separate from, independent of and isolated from the host unit 111. That is, a heat exchanger fluid passing through a refrigeration circuit of the host unit 111 does not travel to the remote fan units 180*a*, 180*b*. The host unit 111 may include one or more heat exchangers (e.g., evaporator(s)), one or more fan(s) for providing climate control within the particular zone the heat exchanger unit is located, one or more flow regulating devices (e.g., solenoid valve(s), etc.) for controlling the amount of heat exchanger fluid flow into the heat exchanger unit, and one or more throttling devices (e.g., electronic throttling valve(s), etc.) for controlling the amount of heat exchanger fluid flow available to a suction end of the compressor of the energy efficient MTRS 100. The host unit 111 and each of the remote fan units 180) can operate in a plurality of operational modes (e.g., a NULL mode, a running NULL mode, a COOL mode, a HEAT mode, a DEFROST mode.

An advantage of using one or more remote fan units as opposed to conventional remote evaporator units is that a lower horsepower engine (e.g., a 20-25 HP engine) can be used. Also, the size of each zone in the transport unit can be easily modified for each trip based on the type and quantity of cargo being transported as the partitions used for separating the zones are not relegated to certain locations based on where the conventional remote evaporator unit(s) are mounted. Also, using one or more remote fan units as opposed to conventional remote evaporator units can improve temperature control by preventing temperature fluctuations that occur when, for example, a conventional remote evaporator unit in the warmest zone comes out of the NULL mode as all the remote fan units can be controlled and operated at the same time.

Figure 2:
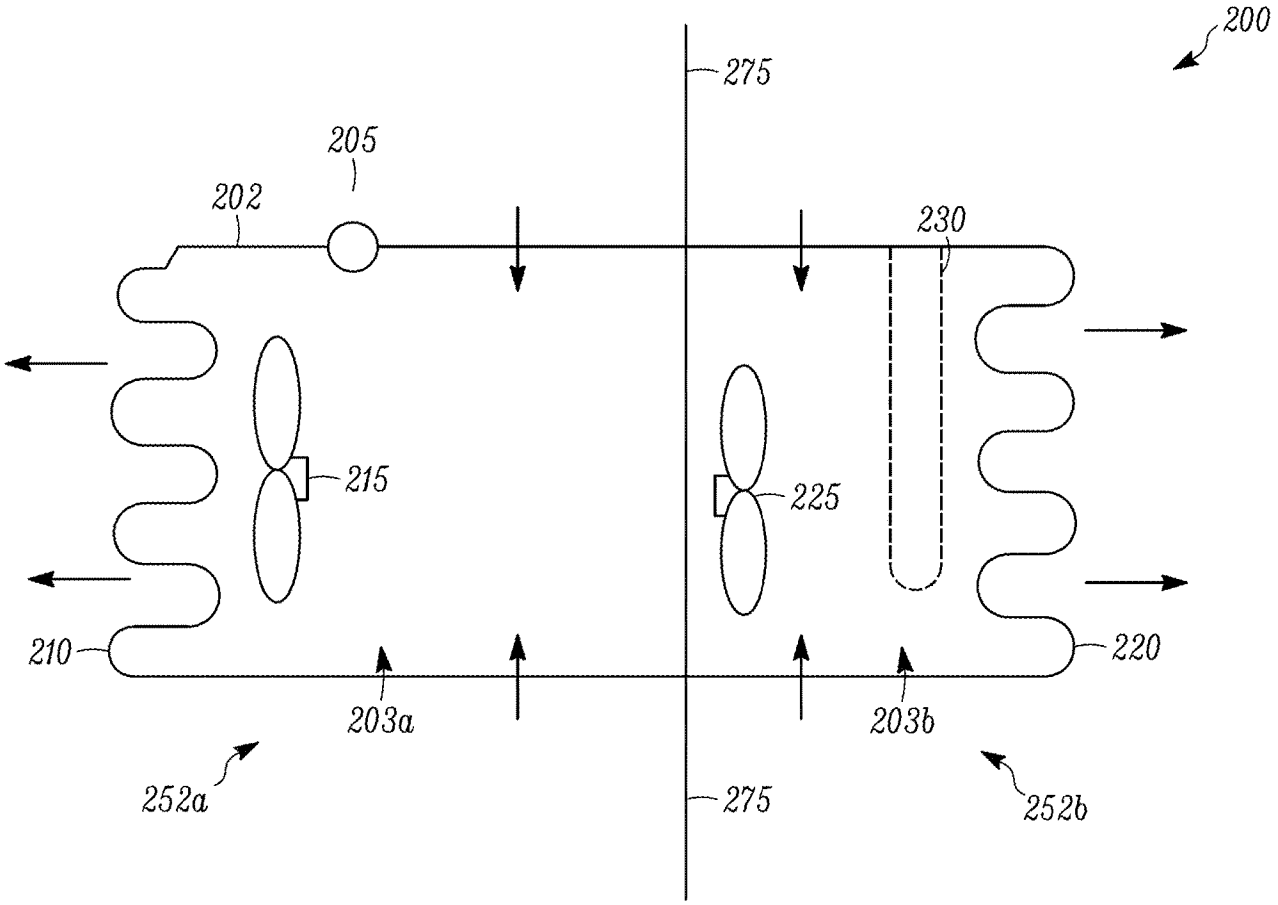
FIG. 2 illustrates a schematic of a fan coil unit of an energy efficient MTRS, according to one embodiment.

FIG. 2 illustrates a schematic of a remote fan unit (e.g., the remote fan units 180 shown in FIG. 1) that is a fan coil unit 200 installed in a transport unit (not shown), according to one embodiment. The fan coil unit 200 is configured to be mounted between a first zone 252*a* and a second zone 252*b* of the transport unit (e.g., as shown in FIG. 1, between the first zone 152*a* and the second zone 152*b*, between the second zone 152*b* and the third zone 152*c*, etc.). As shown in FIG. 2, the first zone 252*a* and the second zone 252*b* are separated and thermally isolated by a zone separator or partition 275. The fan coil unit 200 is mounted on the partition 275. In other embodiments, the fan coil unit 200 can be mounted on the partition 275 and/or a ceiling of the transport unit.

The fan coil unit 200 includes a heat exchange circuit 202 that connects a pump 205, a first zone heat exchanger 210 and a second zone heat exchanger 220 in series so that a fan coil unit heat exchanger fluid can pass therethrough. In one embodiment, the fan coil unit heat exchanger fluid can follow a path from the pump 205, then through the first zone heat exchanger 210, then through the second zone heat exchanger 220 and then back to the pump 205. The fan coil unit 200 also includes a first zone heat exchange fan 215, a second zone heat exchange fan 225 and an optional electric heater 230. As shown in FIG. 2, when installed, a first portion 203*a* of the fan coil unit 200 (including, e.g., the pump 205, the first zone heat exchanger 210 and the first zone heat exchanger fan 215) can be configured to be thermally isolated from a second portion 203*b* of the fan coil unit 200 (including, e.g., the second zone heat exchanger 220 and the second zone heat exchanger fan 225) except via the fan coil unit heat exchanger fluid passing through the heat exchange circuit 202.

The pump 205 is configured to circulate the fan coil unit heat exchanger fluid from the first zone 252*a* to the second zone 252*b* through the heat exchange circuit 202. In some embodiments, the fan coil unit heat exchanger fluid can be a coolant and the pump 205 is a coolant pump. In other embodiments, the fan coil unit heat exchanger fluid can be a radiator fluid, an antifreeze fluid, a eutectic, a refrigerant, etc. It will be appreciated that in some embodiments the fan coil unit heat exchanger fluid is not in fluid communication with other remote fan units or a host unit. For example, if the fan coil unit 200 is the remote fan unit 180*a* shown in FIG. 1, the fan coil unit heat exchanger is not in fluid communication with the remote fan unit 180*b* and the host unit 111. In some embodiments, the pump 205 can be a variable speed pump. Accordingly, the pump 205 can provide temperature control for the fan coil unit 200 by controlling the flow of the fan coil unit heat exchanger fluid passing through the heat exchange circuit 202.

The first zone heat exchanger 210 is configured to exchange heat between air in the first zone 252*a* and the fan coil unit heat exchanger fluid passing through the first zone heat exchanger 210. In some embodiments, the first zone heat exchanger 210 is a first zone heat exchange coil. The first zone heat exchange fan 215 is configured to pull in air from the first zone 252*a* over the first zone heat exchanger 210 in order to facilitate the heat exchange between the air in the first zone 252*a* and the fan coil unit heat exchanger fluid passing through the first zone heat exchanger 210. In other words, the first zone heat exchange fan 215 can control the amount of heat transfer occurring to the fan coil unit heat exchanger fluid passing through the first zone heat exchanger 210. As shown by the arrows in FIG. 2, air from the first zone 252*a* enters the fan coil unit 200 and blown over the first zone heat exchanger 210 by the first zone heat exchange fan 215.

The fan coil unit heat exchanger fluid undergoing a heat transfer when passing through the first zone heat exchanger 210 is then directed to the second zone heat exchanger 220 in order to facilitate heat transfer from the first zone 252*a* to the second zone 252*b*. That is, the second zone heat exchanger 220 is configured to exchange heat between air in the second zone 252*b* and the fan coil unit heat exchanger fluid passing through the second zone heat exchanger 220. In some embodiments, the second zone heat exchanger 220 is a second zone heat exchange coil. The second zone heat exchange fan 225 is configured to blow air from the second zone 252*b* over the second zone heat exchanger 220 in order to facilitate the heat exchange between the air in the second zone 252*b* and the fan coil unit heat exchanger fluid passing through the second zone heat exchanger 220. In other words, the second zone heat exchange fan 225 can provide temperature control within the second zone 252*b*. As shown by the arrows in FIG. 2, air from the second zone 252*b* enters the fan coil unit 200 and blown over the second zone heat exchanger 220 by the second zone heat exchange fan 225.

In some embodiments, the first zone heat exchange fan 215 and the second zone heat exchange fan 225 can be run by a single motor. In other embodiments, the first zone heat exchange fan 215 and the second zone heat exchange fan 225 can each be run by a separate motor. In this embodiment, operation of the first zone heat exchange fan 215 and the second zone heat exchange fan 225 can be controlled separately. For example, the first zone heat exchange fan 215 can be controlled to run at a first speed while the second zone heat exchange fan 225 is controlled to run at a second speed. In another example, the first zone heat exchange fan 215 can be turned off and the second zone heat exchange fan 225 can be controlled to operate or vice versa.

In some embodiments, the fan coil unit 200 can include an optional electric heater 230 that is configured to provide heating to one or more of the first zone 252*a* and the second zone 252*b*. For example, in the embodiment shown in FIG. 2, the optional electric heater 230 is provided adjacent to the second zone heat exchanger 220 (e.g., in the second zone 252*b*) in order to heat the first zone 252*a*. It will be appreciated that in other embodiments, the optional electric heater 230 can be placed adjacent to the first zone heat exchanger 210 (e.g., in the first zone 252*a*) in order to heat or defrost the first zone 2521. Also, in some embodiments a first electric heater can be provided adjacent to the first zone heat exchanger 210 (e.g., in the first zone 252*a*) in order to heat the first zone 252*a* or defrost the first zone heat exchanger 210 and a second electric heater can be provided adjacent to the second zone heat exchanger 220 (e.g., in the first zone 252*b*) in order to heat the second zone 252*b* or defrost the second zone heat exchanger 220.

A MTRS using the fan coil unit 200 can be configured such that the zone temperature controlled by a host unit is set to have the lowest temperature set point when compared to the other zones. The pump 205 can circulate fan coil unit heat exchanger fluid from, for example, the first zone 252*a* to the second zone 252*b* in order to provide a heat exchange between the first zone 252*a* and the second zone 252*b* that enables temperature control of the second zone 252*b*.

An advantage of using a fan coil unit, such as the fan coil unit 200, rather than a conventional remote evaporator unit is that installation can be simplified, cost of a MTRS can be reduced, and the reliability of the MTRS can be increased as less refrigeration system components are required. Also, the MTRS can increase in efficiency as there is a low suction pressure loss using the fan coil unit in contrast to the use of a conventional remote evaporator unit. The heat exchanger fluid charge can be reduced using the fan coil unit in contrast to the use of a conventional remote evaporator unit. Further, the engine size and/or load of the MTRS can be optimized as the MTRS can generally operate at a low set point and/or a low load using a fan coil unit in contrast to the use of a conventional remote evaporator unit. Also, control of the MTRS can be simplified using a fan coil unit in comparison to a conventional remote evaporator unit. Moreover, the number of defrost operations of the MTRS can be reduced as the MTRS includes only a single evaporator with no remote evaporator units. Another advantage of using a fan coil unit rather than a conventional remote evaporator unit can be that the placement of zone separators (e.g., the partition 275) for separating the zones of the transport unit can be adjusted, thereby increasing the flexibility in size of each of the zones of the MTRS.

Thus, the fan coil unit 200 can operate in the NULL mode by turning off the pump 205 and the heat exchange fans 215, 225. The fan coil unit 200 can operate in the Running NULL mode by turning off the pump 205, while letting the heat exchange fans 215, 225 continue to operate. The fan coil unit 200 can operate in the COOL mode by operating the pump 205 and the heat exchange fans 215, 225. The fan coil unit 200 can operate in the HEAT mode by operating the pump 205, the heat exchange fans 215, 225 and the optional electric heater 230. The fan coil unit 200 can operate in the DEFROST mode by operating the heat exchange fans 215, 225 and the optional electric heater 230, and turning off the pump 205.

Figure 3:
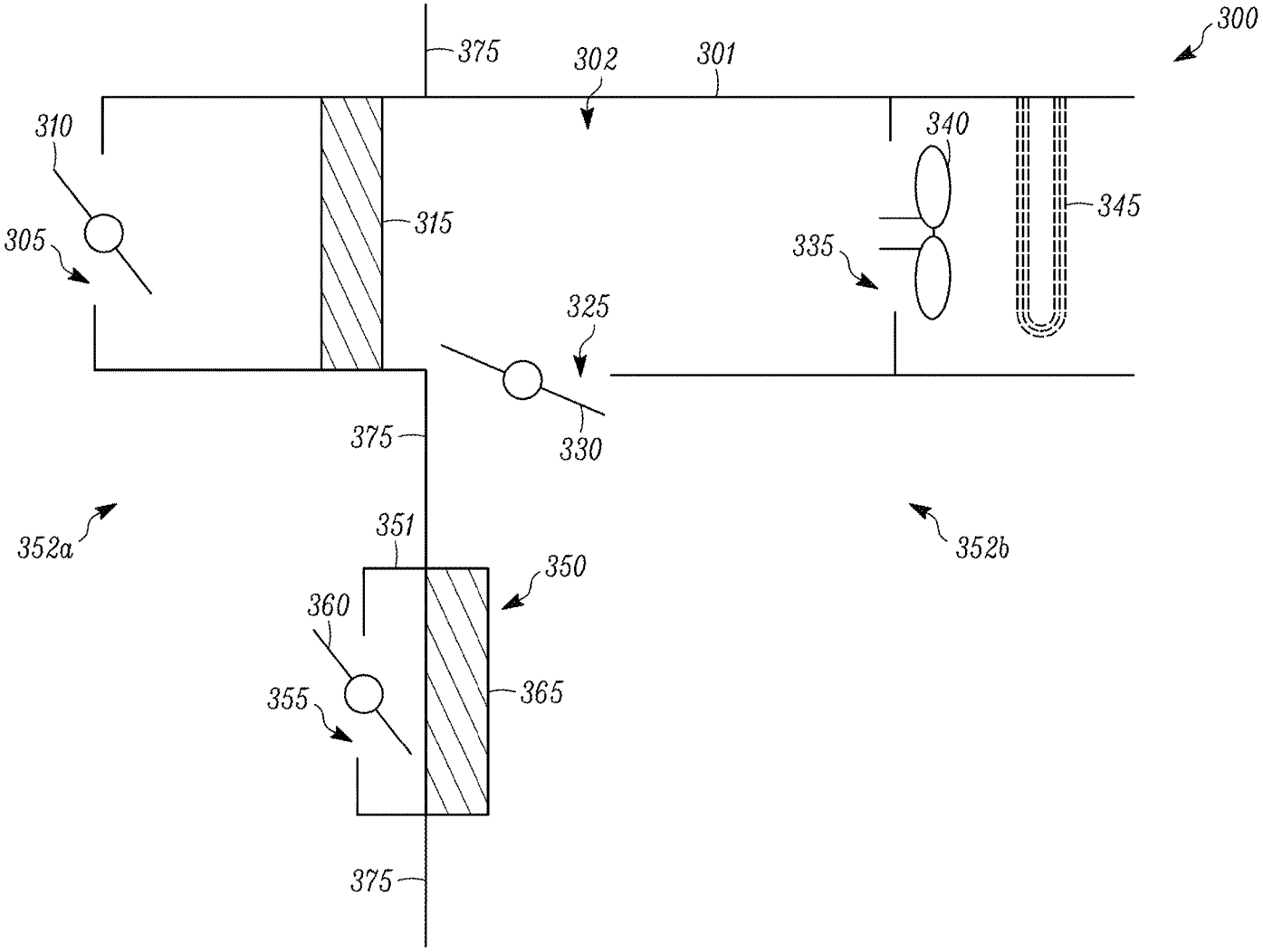
FIG. 3 illustrates a schematic of a filter and fan unit of an energy efficient MTRS, according to another embodiment.

FIG. 3 illustrates a schematic of a remote fan unit (e.g., the remote fan units 180 shown in FIG. 1) that is a filter and fan unit 300 installed in a transport unit (not shown), according to one embodiment. The filter and fan unit 300 is configured to be mounted between a first zone 352*a* and a second zone 352*b* of the transport unit (e.g., as shown in FIG. 1, between the first zone 152*a* and the second zone 152*b*, between the second zone 152*b* and the third zone 152*c*, etc.). As shown in FIG. 3, the first zone 352*a* and the second zone 352*b* are separated and thermally isolated by a zone separator or partition 375. The filter and fan unit 300 is mounted on the partition 375. In other embodiments, the filter and fan unit 300 can be mounted on the partition 375 and/or a ceiling of the transport unit.

The filter and fan unit 300 includes a supply housing 301 defining an interior portion 302 housing a supply filter 315, a fan 340 and optionally an electric heater 345. The supply housing 301 includes a first zone opening 305, a second zone opening 335 and a vacuum prevention opening 325. A first zone damper 310 is provided at the first zone opening 305 and a vacuum prevention damper 330 is provided at the second zone opening 335.

The first zone opening 305 is configured to provide airflow communication between the first zone 352*a* and the interior portion 302 of the filter and fan unit 300. The amount of air allowed to pass through the first zone opening 305 can be controlled by adjusting the position of the first zone damper 310. That is, the position of the first zone damper 310 can be adjusted to completely open the first zone opening 305, can be adjusted to completely close the first zone opening 305, and anything in between. The position of the first zone damper 310 can be adjusted, for example, using a stepper motor to adjust the amount of air that can pass through the first zone opening 305.

The supply filter 315 is configured to purify air from the first zone 352*a* entering the interior portion 302 via the first zone opening 305. In some embodiments, the supply filter 315 can be a high efficient and/or odor control carbon air filter. As shown in FIG. 3, the supply filter 315 is provided adjacent to the first zone opening 305.

The second zone opening 335 is configured to provide airflow communication between the interior portion 302 and second zone 352*b*. The fan 340 is configured to control an air volume within the interior portion 302 being pulled from the first zone 352*a* via the first zone opening 305 into the second zone 352*b* via the second zone opening 335. As shown in FIG. 3, the fan 340 is positioned in the second zone 352*b* and configured to pull air entering the interior portion 302 via the first zone opening 302 and/or the vacuum prevention opening 355 to exit the second zone opening 335. In some embodiments, the fan 340 can be a variable speed fan to adjust the air volume within the interior portion 302 being exchanged between the first zone 352*a* and the second zone 352*b*.

The vacuum prevention opening 325 is configured to allow air from the second zone 352*b* to enter the interior portion 302 in order to prevent a vacuum condition within the filter and fan unit 300. The amount of air allowed to pass through the vacuum prevention opening 325 can be controlled by adjusting the position of the vacuum prevention damper 330. That is, the position of the vacuum prevention damper 330 can be adjusted to completely open the vacuum prevention opening 325, can be adjusted to completely close the vacuum prevention opening 325, and anything in between. The position of the vacuum prevention damper 330 can be adjusted, for example, using a stepper motor to adjust the amount of air that can pass through the vacuum prevention opening 325.

In some embodiments, the filter and fan unit 300 can include an optional electric heater 345 that is configured to provide heating to one or more of the first zone 352*a* and the second zone 352*b*. For example, in the embodiment shown in FIG. 3, the optional electric heater 345 is provided adjacent to the fan 340 in order to heat air passing through the second zone opening 335 in order to exit the interior portion 302 in the second zone 352*b*. It will be appreciated that in other embodiments, the location of the optional electric heater 345 within the interior portion 302 can vary.

The filter and fan unit 300 also includes a return air filter unit 350 is provided. The return air filter unit 350 includes a return air housing 351 having a return air opening 355, a return air damper 360 and a return air filter 365. The return air opening 355 is configured to allow return airflow from the second zone 352*b* to the first zone 352*a*. The amount of air allowed to pass through the return air opening 355 can be controlled by adjusting the position of the return air damper 360. That is, the position of the return air damper 360 can be adjusted to completely open the return air opening 355, can be adjusted to completely close the return air opening 355, and anything in between. The position of the return air damper 360 can be adjusted, for example, using a stepper motor to adjust the amount of air that can pass through the return air opening 355.

The return air filter 365 is configured to purify air passing from the second zone 352*b* to the first zone 352*a* via the return air opening 355. In some embodiments, the return air filter 365 can be a high efficient and/or odor control carbon air filter. As shown in FIG. 3, the return air filter 365 is provided adjacent to the partition 375 at the second zone 352*b*. It will be appreciated that in other embodiments, the return air filter 365 can be provided adjacent to the partition 375 at the first zone 352*a*.

A MTRS using the filter and fan unit 300 can be configured such that a zone temperature controlled by a host unit (e.g., host zone) is set to have the lowest temperature set point when compared to the other zones (e.g., a second zone, a third zone, etc.). The host zone (e.g., the first zone 352*a*)

can exchange air with a zone immediately adjacent to the host zone (e.g., the second zone 352*b*) via the filter and fan unit 300 to provide a heat exchange that enables temperature control for the second zone.

An advantage of using a filter and fan unit, such as the filter and fan unit 300, rather than a conventional remote evaporator unit is that installation can be simplified, cost of a MTRS can be reduced, and the reliability of the MTRS can be increased as less refrigeration system components are required. Also, the MTRS can increase in efficiency as there is a low suction pressure loss using the filter and fan unit in contrast to the use of a conventional remote evaporator unit. The heat exchanger fluid charge can be reduced using the filter and fan unit rather than a conventional remote evaporator unit. Further, the engine size and/or load can be optimized as the MTRS can generally operate at a low set point and/or a low load using the filter and fan unit rather than a conventional remote evaporator unit. Also, control of the MTRS can be simplified using the filter and fan unit rather than a conventional remote evaporator unit. Moreover, the number of defrost operations of the MTRS can be reduced as the MTRS includes only a single evaporator in the host unit with no remote evaporator units. Another advantage of using the filter and fan unit rather than a conventional remote evaporator unit can be that the placement of zone separators (e.g., the partition 375) for separating the zones of the transport unit can be adjusted, thereby increasing the flexibility in size of each of the zones of the MTRS. The filter and fan unit(s) can be mounted on a zone separator and/or a ceiling of the transport unit.

Aspects:

It is appreciated that any of aspects 1-12 and 13-22 can be combined.

1. A refrigerated transport unit comprising:
   a multi-zone transport unit including an internal space separated into a first zone and a second zone, wherein the internal space including a zone separator separating and thermally isolating the first zone and the second zone;
   an energy efficient multi-zone transport refrigeration system (MTRS) configured to control and maintain a separate environmental condition requirement of each of the first zone and the second zone, the MTRS including:
   a remote fan unit provided between the first zone and the second zone, the remote fan unit configured to provide a heat exchange between the first zone and the second zone for providing climate control within the second zone.
2. The refrigerated transport unit of aspect 1, wherein the MTRS further includes a host unit configured to provide climate control within the first zone, wherein the remote fan unit is isolated from the host unit.
3. The refrigerated transport unit of aspect 1 or 2, wherein the remote fan unit is a fan coil unit that includes:
   a first portion provided in the first zone and a second portion provided in the second zone;
   a heat exchange circuit including a pump and a first zone heat exchanger provided in the first zone, and a second zone heat exchanger provided in the second zone;
   wherein the pump is configured to circulate fan coil unit heat circulate a fan coil heat exchanger fluid from the first zone to the second zone via the heat exchange circuit;
   wherein the first zone heat exchanger is configured to exchange heat between air in the first zone and the fan coil unit heat exchanger fluid passing through the first zone heat exchanger; and
   wherein the second zone heat exchanger is configured to exchange heat between air in the second zone and the fan coil unit heat exchanger fluid passing through the second zone heat exchanger.
4. The refrigerated transport unit of aspect 3, further comprising a host unit separate from, independent of, and isolated from the fan coil unit, wherein the host unit configured to provide climate control within the first zone, and wherein the host unit includes a host heat exchanger circuit for directing a host heat exchange fluid that is separate from, independent of, and isolated from the fan coil unit heat exchanger fluid.
5. The refrigerated transport unit of either of aspects 3 or 4, wherein the first portion includes a first zone heat exchange fan configured to blow air from the first zone over the first zone heat exchanger, and wherein the second portion includes a second zone heat exchange fan configured to blow air from the second zone over the second zone heat exchanger.
6. The refrigerated transport unit of any one of aspects 3-5, wherein the fan coil unit includes an electric heater positioned adjacent to the second zone heat exchanger, wherein the electric heater is configured to heat the fan coil unit heat exchanger fluid passing through the second zone heat exchanger in order to provide heating to the second zone.
7. The refrigerated transport unit of aspect 1 or 2, wherein the remote fan unit is a filter and fan unit that includes:
   a housing defining an interior portion having a first zone opening and a second zone opening;
   the first zone opening configured to provide airflow communication between the first zone and the interior portion;
   an adjustable first zone damper provided at the first zone opening, the first zone damper configured to control an amount of air allowed to pass through the first zone opening;
   the second zone opening configured to provide airflow communication between the second zone and the interior portion;
   a supply filter provided in the interior portion, the supply filter configured to purify air entering the interior portion via the first zone opening;
   a fan provided in the interior portion, the fan configured to control an air volume within the interior portion exiting the second zone via the second zone opening.
8. The refrigerated transport unit of aspect 7, wherein the filter is a high efficient carbon air filter.
9. The refrigerated transport unit of aspect 7, wherein the filter is an odor control carbon air filter.
10. The refrigerated transport unit of any one of aspects 7-9, wherein the housing includes a vacuum prevention opening and a vacuum prevention damper provided at the vacuum prevention opening, the vacuum prevention damper configured to control an amount of air allowed to enter the housing through the vacuum prevention opening to prevent a vacuum condition within the housing.
11. The refrigerated transport unit of any one of aspect 7-10, wherein the filter and fan unit includes an electric heater provided in the interior portion adjacent to the second zone opening, the electric heater configured to provide heating to air passing through the second zone opening and out of the housing.

12. The refrigerated transport unit of any one of aspects 7-11, further comprising a return air filter unit including a return air housing having:
   a return air opening configured to provide airflow communication between the second zone and the first zone,
   an adjustable return air damper provided at the return air opening, the return air damper configured to control an amount of air allowed to pass through the return air opening into the first zone, and
   a return air filter provided in the return air housing, the return air filter configured to purify air from the second zone passing through the return air filter unit including the return air opening into the first zone.
13. An energy efficient multi-zone transport refrigeration system (MTRS) configured to control and maintain a separate environmental condition requirement of each of a first zone and a second zone within an interior space of a transport unit, the MTRS including:
   a host unit configured to provide climate control within the first zone, wherein the host unit includes a host heat exchanger circuit for directing a host heat exchange fluid;
   a remote fan unit provided between the first zone and the second zone, wherein the remote fan unit is separate from, independent of, and isolated from the host unit, and wherein the remote fan unit is configured to provide a heat exchange between the first zone and the second zone for providing climate control within the second zone.
14. The MTRS of aspect 13, wherein the remote fan unit is a fan coil unit that includes:
   a first portion provided in the first zone and a second portion provided in the second zone;
   a heat exchange circuit including a pump and a first zone heat exchanger provided in the first zone, and a second zone heat exchanger provided in the second zone, wherein the heat exchange circuit providing thermal communication between the first portion and the second portion;
   wherein the pump is configured to circulate fan coil unit heat circulate a fan coil heat exchanger fluid from the first zone to the second zone via the heat exchange circuit;
   wherein the first zone heat exchanger is configured to exchange heat between air in the first zone and the fan coil unit heat exchanger fluid passing through the first zone heat exchanger, the fan coil unit heat exchanger fluid is separate from, independent of, and isolated from the host heat exchanger fluid; and
   wherein the second zone heat exchanger is configured to exchange heat between air in the second zone and the fan coil unit heat exchanger fluid passing through the second zone heat exchanger.
15. The MTRS of aspect 14, wherein the first portion includes a first zone heat exchange fan configured to blow air from the first zone over the first zone heat exchanger, and wherein the second portion includes a second zone heat exchange fan configured to blow air from the second zone over the second zone heat exchanger.
16. The MTRS of either one of aspects 14 or 15, wherein the fan coil unit includes an electric heater positioned adjacent to the second zone heat exchanger, wherein the electric heater is configured to heat the fan coil unit heat exchanger fluid passing through the second zone heat exchanger in order to provide heating to the second zone.
17. The MTRS of aspect 13, wherein the remote fan unit is a filter and fan unit that includes:
   a housing defining an interior portion having a first zone opening and a second zone opening;
   the first opening configured to provide airflow communication between the first zone and the interior portion;
   an adjustable first zone damper provided at the first zone opening, the first zone damper configured to control an amount of air allowed to pass through the first zone opening;
   the second zone opening configured to provide airflow communication between the second zone and the interior portion;
   a supply filter provided in the interior portion, the supply filter configured to purify air entering the interior portion via the first zone opening;
   a fan provided in the interior portion, the fan configured to control an air volume within the interior portion exiting the second zone via the second zone opening.
18. The MTRS of aspect 17, wherein the filter is a high efficient carbon air filter.
19. The MTRS of aspect 17, wherein the filter is an odor control carbon air filter.
20. The MTRS of any one of aspects 17-19, wherein the housing includes a vacuum prevention opening and a vacuum prevention damper provided at the vacuum prevention opening, the vacuum prevention damper configured to control an amount of air allowed to enter the housing through the vacuum prevention opening to prevent a vacuum condition within the housing.
21. The MTRS of any one of aspects 17-20, wherein the filter and fan unit includes an electric heater provided in the interior portion adjacent to the second zone opening, the electric heater configured to provide heating to air passing through the second zone opening and out of the housing.
22. The MTRS of any one of aspects 17-21, further comprising a return air filter unit including a return air housing having:
   a return air opening configured to provide airflow communication between the second zone and the first zone,
   an adjustable return air damper provided at the return air opening, the return air damper configured to control an amount of air allowed to pass through the return air opening into the first zone, and
   a return air filter provided in the return air housing, the return air filter configured to purify air from the second zone passing through the return air filter unit including the return air opening into the first zone.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A refrigerated transport unit comprising:
   a multi-zone transport unit including an internal space separated into a first zone and a second zone, wherein the internal space including a zone separator separating and thermally isolating the first zone and the second zone;
   an energy efficient multi-zone transport refrigeration system (MTRS) configured to control and maintain a separate environmental condition requirement of each of the first zone and the second zone, the MTRS including:

a remote fan unit provided between the first zone and the second zone, the remote fan unit configured to provide a heat exchange between the first zone and the second zone for providing climate control within the second zone, wherein the remote fan unit is a fan coil unit that includes within a single remote fan unit housing:

a first portion provided in the first zone and a second portion provided in the second zone, a heat exchange circuit including a pump and a first zone heat exchanger provided in the first zone, and a second zone heat exchanger provided in the second zone, and a partition separating the first portion from the second portion within the remote fan unit housing, wherein the pump is configured to circulate a fan coil heat exchanger fluid from the first zone to the second zone via the heat exchange circuit;

wherein the first zone heat exchanger is configured to exchange heat between air in the first zone and the fan coil unit heat exchanger fluid passing through the first zone heat exchanger; and wherein the second zone heat exchanger is configured to exchange heat between air in the second zone and the fan coil unit heat exchanger fluid passing through the second zone heat exchanger.

2. The refrigerated transport unit of claim 1, wherein the MTRS further includes a host unit configured to provide climate control within the first zone, wherein the remote fan unit is isolated from the host unit.

3. The refrigerated transport unit of claim 1, further comprising a host unit separate from, independent of, and isolated from the fan coil unit, wherein the host unit is configured to provide climate control within the first zone, and wherein the host unit includes a host heat exchanger circuit for directing a host heat exchange fluid that is separate from, independent of, and isolated from the fan coil unit heat exchanger fluid.

4. The refrigerated transport unit of claim 1, wherein the first portion includes a first zone heat exchange fan configured to blow air from the first zone over the first zone heat exchanger, and wherein the second portion includes a second zone heat exchange fan configured to blow air from the second zone over the second zone heat exchanger.

5. The refrigerated transport unit of claim 1, wherein the fan coil unit includes an electric heater positioned adjacent to the second zone heat exchanger, wherein the electric heater is configured to heat the fan coil unit heat exchanger fluid passing through the second zone heat exchanger in order to provide heating to the second zone.

6. An energy efficient multi-zone transport refrigeration system (MTRS) configured to control and maintain a separate environmental condition requirement of each of a first zone and a second zone within an interior space of a transport unit, the MTRS including:

a host unit configured to provide climate control within the first zone, wherein the host unit includes a host heat exchanger circuit for directing a host heat exchange fluid;

a remote fan unit provided between the first zone and the second zone, wherein the remote fan unit is separate from, independent of, and isolated from the host unit, and wherein the remote fan unit is configured to provide a heat exchange between the first zone and the second zone for providing climate control within the second zone, wherein the remote fan unit is a fan coil unit that includes within a single remote fan unit housing:

a first portion provided in the first zone and a second portion provided in the second zone, a heat exchange circuit including a pump and a first zone heat exchanger provided in the first zone, and a second zone heat exchanger provided in the second zone, wherein the heat exchange circuit providing thermal communication between the first portion and the second portion, and a partition separating the first portion from the second portion within the remote fan unit housing, wherein the pump is configured to circulate a fan coil heat exchanger fluid from the first zone to the second zone via the heat exchange circuit;

wherein the first zone heat exchanger is configured to exchange heat between air in the first zone and the fan coil unit heat exchanger fluid passing through the first zone heat exchanger, the fan coil unit heat exchanger fluid is separate from, independent of, and isolated from the host heat exchanger fluid; and wherein the second zone heat exchanger is configured to exchange heat between air in the second zone and the fan coil unit heat exchanger fluid passing through the second zone heat exchanger.

7. The MTRS of claim 6, wherein the first portion includes a first zone heat exchange fan configured to blow air from the first zone over the first zone heat exchanger, and wherein the second portion includes a second zone heat exchange fan configured to blow air from the second zone over the second zone heat exchanger.

8. The MTRS of claim 6, wherein the fan coil unit includes an electric heater positioned adjacent to the second zone heat exchanger, wherein the electric heater is configured to heat the fan coil unit heat exchanger fluid passing through the second zone heat exchanger in order to provide heating to the second zone.

9. The refrigerated transport unit of claim 1, wherein the first portion is thermally isolated via the partition from the second portion within the remote fan unit housing.

10. The MTRS of claim 6, wherein the first portion is thermally isolated via the partition from the second portion within the remote fan unit housing.

11. The refrigerated transport unit of claim 1, wherein the pump is a variable speed pump that can provide temperature control for the fan coil unit by controlling a flow of the fan coil unit heat exchanger fluid passing through the heat exchange circuit.

12. The MTRS of claim 6, wherein the pump is a variable speed pump that can provide temperature control for the fan coil unit by controlling a flow of the fan coil unit heat exchanger fluid passing through the heat exchange circuit.

13. The refrigerated transport unit of claim 1, wherein the first portion includes a first zone heat exchange fan configured to pull the air in the first zone over the first zone heat exchanger to facilitate a heat exchange between the air in the first zone and the fan coil unit heat exchanger fluid passing through the first zone heat exchanger, and the second portion includes a second zone heat exchange fan configured to blow air from the second zone over the second zone heat exchanger to facilitate a heat exchange between the air in the second zone and the fan coil unit heat exchanger fluid passing through the second zone heat exchanger.

14. The refrigerated transport unit of claim 13, wherein the first zone heat exchange fan and the second zone heat exchange fan are each run by a separate motor.

15. The refrigerated transport unit of claim 13, wherein a controller is configured to operate the remote fan unit in:

a NULL mode by turning off the pump, the first zone heat exchange fan and the second zone heat exchange fan, a Running NULL mode by turning off the pump and continuing to operate at least one of the first zone heat exchange fan and the second zone heat exchange fan, and a COOL mode by operating the pump and at least one of the first zone heat exchange fan and the second zone heat exchange fan.

16. The MTRS of claim 6, wherein the first portion includes a first zone heat exchange fan configured to pull the air in the first zone over the first zone heat exchanger to facilitate a heat exchange between the air in the first zone and the fan coil unit heat exchanger fluid passing through the first zone heat exchanger, and the second portion includes a second zone heat exchange fan configured to blow air from the second zone over the second zone heat exchanger to facilitate a heat exchange between the air in the second zone and the fan coil unit heat exchanger fluid passing through the second zone heat exchanger.

17. The MTRS of claim 16, wherein the first zone heat exchange fan and the second zone heat exchange fan are each run by a separate motor.

18. The MTRS of claim 16, wherein a controller is configured to operate the remote fan unit in:

a NULL mode by turning off the pump, the first zone heat exchange fan and the second zone heat exchange fan, a Running NULL mode by turning off the pump and continuing to operate at least one of the first zone heat exchange fan and the second zone heat exchange fan, and a COOL mode by operating the pump and at least one of the first zone heat exchange fan and the second zone heat exchange fan.

* * * * *